US009840385B2

(12) United States Patent
Kodama et al.

(10) Patent No.: US 9,840,385 B2
(45) Date of Patent: Dec. 12, 2017

(54) CORRUGATED PAPERBOARD SHEET FEEDING APPARATUS

(71) Applicant: KABUSHIKI KAISHA ISOWA, Nagoya-shi, Aichi (JP)

(72) Inventors: Junichi Kodama, Kasugai (JP); Shunsuke Miyashita, Kasugai (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 0 days.

(21) Appl. No.: 15/247,124

(22) Filed: Aug. 25, 2016

(65) Prior Publication Data

US 2017/0057766 A1 Mar. 2, 2017

(30) Foreign Application Priority Data

Sep. 2, 2015 (JP) ..... 2015-173163

(51) Int. Cl.

| | |
|---|---|
| ***B65H 3/08*** | (2006.01) |
| ***B65H 7/20*** | (2006.01) |
| ***B65H 3/06*** | (2006.01) |
| ***B65H 3/12*** | (2006.01) |
| ***B65H 7/02*** | (2006.01) |

(52) U.S. Cl.

CPC ..... *B65H 3/08* (2013.01); *B65H 3/063* (2013.01); *B65H 3/0692* (2013.01); *B65H 3/122* (2013.01); *B65H 3/126* (2013.01); *B65H 7/02* (2013.01); *B65H 7/20* (2013.01); *B65H 2406/3122* (2013.01)

(58) Field of Classification Search

CPC ..... B65H 3/063; B65H 3/126; B65H 3/122; B65H 3/0692; B65H 2406/3122

See application file for complete search history.

(56) References Cited

U.S. PATENT DOCUMENTS

| | | | | |
|---|---|---|---|---|
| 4,614,335 A | | 9/1986 | Sardella | |
| 4,828,244 A | * | 5/1989 | Sardella | B65H 3/063 271/102 |
| 5,048,812 A | * | 9/1991 | Holmes | B65H 3/063 271/11 |
| 5,184,811 A | * | 2/1993 | Sardella | B65H 3/063 271/10.11 |
| 5,228,674 A | * | 7/1993 | Holmes | B65H 3/063 271/11 |

(Continued)

FOREIGN PATENT DOCUMENTS

JP 4976362 B2 7/2012

*Primary Examiner* — Patrick Cicchino

(74) *Attorney, Agent, or Firm* — Brinks Gilson & Lione

(57) ABSTRACT

A corrugated paperboard sheet feeding apparatus comprises: a plurality of sheet feeding rollers; a grate formed with a plurality of opening portions for receiving the sheet feeding rollers and configured to switch between contact and non-contact states of the corrugated paperboard sheet with respect to the sheet feeding rollers; and a suction box configured to suck the corrugated paperboard sheet downwardly by gaps between the sheet feeding rollers and the opening portions, wherein each of the gaps is formed to be 10 mm or less, and wherein the apparatus further comprises a mat switch for detecting an entry of a person into an area in a sheet feeding section, and a control device for stopping movement of the sheet feeding rollers and/or the grate when the mat switch is turned on.

7 Claims, 10 Drawing Sheets

(56) References Cited

U.S. PATENT DOCUMENTS

| | | | | | |
|---|---|---|---|---|---|
| 5,531,432 | A * | 7/1996 | Sardella | B65H 3/063 | 271/10.01 |
| 5,798,703 | A * | 8/1998 | Sakai | F16P 3/12 | 307/119 |
| 9,045,297 | B2 * | 6/2015 | Takamori | B65H 7/06 | |
| 9,162,834 | B1 * | 10/2015 | Lee | B65H 3/063 | |
| 2016/0200532 | A1 * | 7/2016 | Kodama | B65H 3/063 | 271/10.12 |

* cited by examiner

< Configuration of Comparative Example >

< Configuration of Embodiment >

FD
1
1a
2
3
4
4a
4X
4Xa
G11
G12
G21
G22
16
28

CORRUGATED PAPERBOARD SHEET FEEDING APPARATUS

RELATED APPLICATIONS

This application claims priority under 35 U.S.C. §119 to Japanese Patent Application No. 2015-173163 filed on Sep. 2, 2015, the entire content of which is hereby incorporated by reference.

BACKGROUND OF THE INVENTION

Field of the Invention

The present invention relates to a corrugated paperboard sheet feeding apparatus and more particularly to a corrugated paperboard sheet feeding apparatus for feeding out a plurality of stacked corrugated paperboard sheets one-by-one.

Description of Related Art

Heretofore, a corrugated paperboard box making machine has been constructed by employing a corrugated paperboard sheet feeding apparatus for feeding out a plurality of stacked corrugated paperboard sheets one-by-one toward a printing apparatus, using a plurality of sheet feeding rollers rotatably arranged along a feed-out direction of the corrugated paperboard sheets, and a grate (as an elevating member) configured to be raised and lowered with respect to the sheet feeding rollers to thereby control contact and non-contact of a lowermost one of the corrugated paperboard sheets with respect to the sheet feeding rollers (so-called "rotary feeder").

This type of corrugated paperboard sheet feeding apparatus is disclosed, for example, in Patent Document 1 (U.S. Pat. No. 4,614,335A) and Patent Document 2 (JP 4976362B). Specifically, the Patent Document 1 discloses a corrugated paperboard sheet feeding apparatus in which a rotational motion of a drive shaft is converted to respective motions of a plurality of components through a mechanical transmission.

On the other hand, the Patent Document 2 discloses a corrugated paperboard sheet feeding apparatus configured to move a plurality of components by controlling a drive motor based on a given speed control pattern (under electronic cam control), thereby eliminating a need for the mechanical transmission as described in the Patent Document 1.

BRIEF SUMMARY OF THE INVENTION

Technical Problem

In a commonly-used corrugated paperboard sheet feeding apparatus, a grate is formed with a plurality of opening portions capable of receiving therein a plurality of sheet feeding rollers, respectively, in such a manner as to allow the grate to perform upward and downward (rising and lowering) movements while slipping through the sheet feeding rollers. Thus, when a worker performs work in a sheet feeding section including the sheet feeding rollers and the grate (e.g., performs the work of aligning edges of a plurality of corrugated paperboard sheets placed on the sheet feeding section, or the work of correcting a jamming in the corrugated paperboard sheets placed on the sheet feeding section) during operation of the corrugated paperboard sheet feeding apparatus, there is a risk that fingers of the worker entering a gap between a certain one of the sheet feeding rollers and a corresponding one of the opening portions of the grate are caught between the certain sheet feeding roller and the grate.

More specifically, the gap between each of the sheet feeding rollers and a corresponding one of the opening portions of the grate becomes smaller when the grate is at a lowered position than when the grate is at a raised position. Thus, in a situation where the fingers enter the gap when the grate is located around the raised position and then the grate is moved downwardly in the state in which the fingers enter the gap, the fingers are likely to be caught between a certain one of the sheet feeding rollers and the corresponding grate. Therefore, in a conventional corrugated paperboard sheet feeding apparatus, the gap between each of the sheet feeding rollers and a corresponding one of the opening portions of the grate is defined to have a relatively large size enough to reliably prevent the fingers from being caught between a certain one of the sheet feeding rollers and the grate.

As used in this specification, the term "opening portion" of the grate does not mean a through-hole (opening) itself capable of receiving therein the sheet feeding roller, but means a portion of the grate including the through-hole, i.e., a portion of the grate including not only the through-hole but also an peripheral edge region defining the through-hole.

Meanwhile, in the commonly-used corrugated paperboard sheet feeding apparatus, the plurality of sheet feeding rollers and the grate are provided in an upper region of a suction box as a housing, and the suction box is provided with a suction device and configured to be suctioned by the suction device to suck a lowermost one of the stacked corrugated paperboard sheets downwardly, primarily through the gaps between corresponding ones of the sheet feeding rollers and the opening portions of the grate. By applying a downward suction force to the lowermost corrugated paperboard sheet to thereby bias the lowermost corrugated paperboard sheet toward the sheet feeding rollers, a gripping force can be adequately applied from the sheet feeding rollers to the lowermost corrugated paperboard sheet to ensure accuracy in feeding out the lowermost corrugated paperboard sheet by the sheet feeding rollers.

In this case, when the lowermost corrugated paperboard sheet is placed on an approximately entire region of the sheet feeding rollers and the grate (i.e., in an earlier stage of feed-out of the lowermost corrugated paperboard sheet), the gaps between corresponding ones of the sheet feeding rollers and the opening portions of the grate are approximately fully closed by the lowermost corrugated paperboard sheet, and thereby a negative pressure generated in the suction box by the suction device has a relatively large value. However, as the lowermost corrugated paperboard sheet is gradually fed out, a part of the region of the sheet feeding rollers and the grate is formed as an exposed region on which no corrugated paperboard sheet is placed, so that air is allowed to flow into the suction box through a part of the gaps between corresponding ones of the sheet feeding rollers and the opening portions of the grate in the exposed region, and thereby the negative pressure generated in the suction box by the suction device gradually becomes smaller. For this reason, during feed-out of the lowermost corrugated paperboard sheet in the corrugated paperboard sheet feeding apparatus, the negative pressure generated in the suction box by the suction device changes. If the change in the negative pressure is large (in particular, when the negative pressure is largely reduced), an adequate gripping force cannot be applied from the sheet feeding rollers to the lowermost corrugated paperboard sheet, thereby causing deterioration in accuracy in feeding out the lowermost corrugated paperboard sheet by the sheet feeding rollers, resulting in occurrence of a deviation in sheet feeding by the corrugated paperboard sheet feeding apparatus.

As means to reduce the change in the negative pressure generated in the suction box, it is conceivable to reduce a size of the gap between each of the sheet feeding rollers and a corresponding one of the opening portions of the grate. When the gap between each of the sheet feeding rollers and a corresponding one of the opening portions of the grate is reduced in size, an amount of air to be allowed to flow into the suction box through the gap is reduced, and thus the change in the negative pressure is reduced. On the other hand, when the gap between each of the sheet feeding rollers and a corresponding one of the opening portions of the grate is reduced in size, it becomes highly likely that worker's fingers are caught between a certain one of the sheet feeding rollers and the grate.

It is therefore an object of the present invention to provide a corrugated paperboard sheet feeding apparatus capable of reducing a change in negative pressure generated in a housing according to suctioning, to suppress a deviation in sheet feeding during feed-out of a corrugated paperboard sheet, while preventing worker's fingers from being caught between a sheet feeding roll and a grate (elevating member).

Solution to Problem

In order to achieve the above object, the present invention provides a corrugated paperboard sheet feeding apparatus for feeding out a plurality of stacked corrugated paperboard sheets one-by-one. The corrugated paperboard sheet feeding apparatus comprises: a plurality of sheet feeding rollers rotatably arranged along a feed-out direction of the corrugated paperboard sheets, and configured to feed out a lowermost one of the stacked corrugated paperboard sheets; an elevating member (a raisable-lowerable member) formed in a plate shape to allow the lowermost corrugated paperboard sheet to be placed thereon and formed with a plurality of opening portions capable of receiving therein the plurality of sheet feeding rollers, respectively, wherein the elevating member is configured to be raised and lowered with respect to the sheet feeding rollers to thereby switch between a contact state and a non-contact state of the lowermost corrugated paperboard sheet with respect to the sheet feeding rollers; and a housing having an upper region in which the sheet feeding rollers and the elevating member are provided to define a part of an upper surface of the housing, wherein the housing is further provided with a suction device and configured to suck the lowermost corrugated paperboard sheet downwardly through gaps between corresponding ones of the sheet feeding rollers and the opening portions of the elevating member, by using suctioning of the suction device; wherein each of the gaps between corresponding ones of the sheet feeding rollers and the opening portions of the elevating member is formed to be 10 mm or less in size, and wherein the corrugated paperboard sheet feeding apparatus further comprises: a human detecting device operable to detect an entry of a person into an area for performing work in a sheet feeding section including the sheet feeding rollers and the elevating member, during feed-out of the corrugated paperboard sheets; and a control device operable, when the human detecting device detects the entry of a person, to stop movement of at least one of the sheet feeding rollers and the elevating member.

In the present invention having the above feature, a change in negative pressure generated in the housing by the suction device can be reduced, so that it becomes possible to continue to adequately apply a gripping force from the sheet feeding rollers to the lowermost corrugated paperboard sheet during feed-out of the lowermost corrugated paperboard sheet. This makes it possible to ensure accuracy in feed-out of the lowermost corrugated paperboard sheet, i.e., to improve a deviation in sheet feeding during feed-out from the corrugated paperboard sheet feeding apparatus.

In the corrugated paperboard sheet feeding apparatus of the present invention, the human detecting device is used to detect an entry of a person into the area for performing work in the sheet feeding section, and the control device is operable, when the human detecting device detects the entry of a person, to stop movement of the sheet feeding rollers and/or the elevating member. This makes it possible to prevent fingers of the person from being caught between a certain one of the sheet feeding rolls and the elevating member.

Preferably, in the present invention, the control device is operable to stop the movement of at least one of the sheet feeding rollers and the elevating member, at a timing when one operation cycle of the sheet feeding rollers and the elevating member for feeding out the lowermost corrugated paperboard sheet is completed.

According to this feature, the control device is operable to stop the movement of the sheet feeding rollers and/or the elevating member, at the timing when the one operation cycle of the sheet feeding rollers and the elevating member is completed, after the human detecting device detects the entry of a person. This makes it possible to avoid the occurrence of a situation where the movement is stopped in the course of the one operation cycle, and thereby suppress defective feed-out of a corrugated paperboard sheet and defective processing (e.g., defective printing) on a downstream side of the corrugated paperboard sheet feeding apparatus.

Preferably, the corrugated paperboard sheet feeding apparatus of the present invention further comprises a release button for releasing a stopped state of the at least one of the sheet feeding rollers and the elevating member, established by the control device, wherein the control device is operable, when the human detecting device comes not to detect any person, and the release button is turned on, to release the stopped state of the at least one of the sheet feeding rollers and the elevating member and restart the movement of the at least one of them.

According to this feature, when the human detecting device comes not to detect any person in a situation where the movement of the sheet feeding rollers and/or the elevating member is stopped, and the release button is turned on, the control device is operable to release the stopped state of the sheet feeding rollers and/or the elevating member, and restart the movement of the sheet feeding rollers and/or the elevating member. This makes it possible to restart the movement of the sheet feeding rollers and/or the elevating member under a condition that there is no possibility that fingers of the person are caught between any one of the sheet feeding rolls and the elevating member.

Preferably, in the present invention, the control device is operable to stop respective movements of both the sheet feeding rollers and the elevating member.

According to this feature, it becomes possible to more reliably prevent fingers of the person from being caught between a certain one of the sheet feeding rolls and the elevating member.

Preferably, in the present invention, the control device is operable to stop only the movement of the elevating member without stopping the movement of the sheet feeding rollers.

The event that fingers of the person are caught between a certain one of the sheet feeding rolls and the elevating member is primarily caused by the movement of the elevating member. According to this feature, only the movement of the elevating member is stopped while the movement of the sheet feeding rolls is maintained. This makes it possible to minimize the number of components to be stopped, and thereby facilitate restarting from the stopped state.

Preferably, in the present invention, each of the gaps between corresponding ones of the sheet feeding rollers and the opening portions of the elevating member is formed to be 5 mm or less in size.

According to this feature, each of the gaps between corresponding ones of the sheet feeding rollers and the opening portions of the elevating member is defined to have a gap distance of 5 mm or less. This makes it possible to more effectively reduce the change in negative pressure generated in the housing by the suction device and thereby significantly improve the deviation in sheet feeding during feed-out from the corrugated paperboard sheet feeding apparatus.

Preferably, in the present invention, the human detecting device is a mat switch provided on a floor surface of the area for performing work in the sheet feeding section.

According to this feature, it becomes possible to reliably detect an entry of the above area, with a simple configuration.

Preferably, in the present invention, the sheet feeding rollers and the elevating member are configured to be driven independently of an apparatus which performs processing of the corrugated paperboard sheet fed out from the corrugated paperboard sheet feeding apparatus, and which is disposed on a downstream side of the corrugated paperboard sheet feeding apparatus.

According to this feature, it becomes possible to adequately continue an operation of an apparatus located on the downstream side of the corrugated paperboard sheet feeding apparatus, even when the movement of the sheet feeding rollers and/or the elevating member is stopped. This makes it possible to allow the apparatus located on the downstream side of the corrugated paperboard sheet feeding apparatus to adequately perform processing for a corrugated paperboard sheet which has already been fed out from the corrugated paperboard sheet feeding apparatus, irrespective of whether the sheet feeding rollers and/or the elevating member is in the stopped state.

The corrugated paperboard sheet feeding apparatus of the present invention is capable of reducing the change in negative pressure generated in the housing according to suctioning, to suppress the deviation in sheet feeding during feed-out of a corrugated paperboard sheet, while preventing worker's fingers from being caught between a sheet feeding roll and a grate.

DETAILED DESCRIPTION OF THE INVENTION

With reference to the accompanying drawings, a corrugated paperboard sheet feeding apparatus according to one embodiment of the present invention will now be described.

<Overall Configuration>

Figure 1:
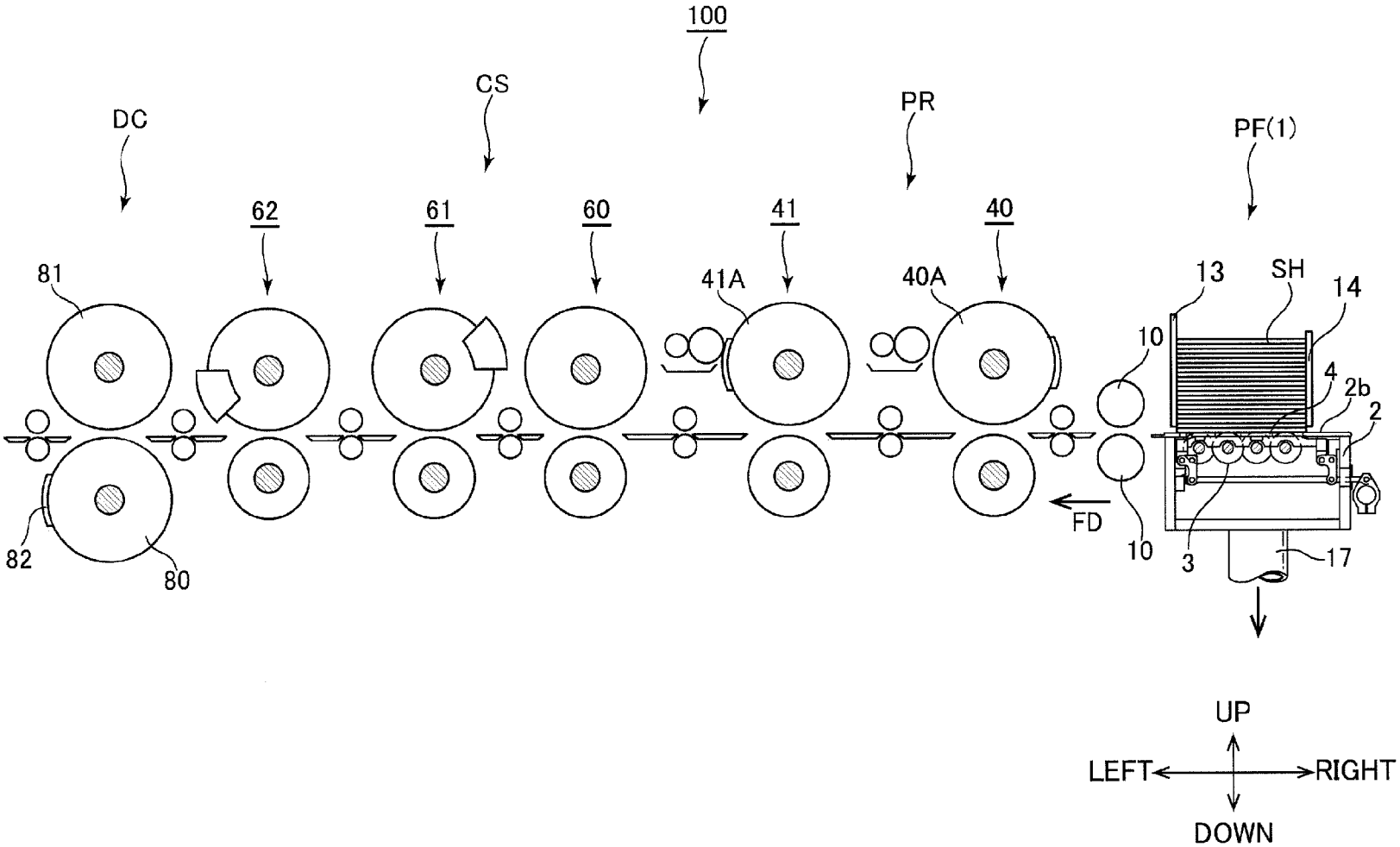
FIG. 1 is a schematic side view depicting an entirety of a corrugated paperboard box making machine employing a corrugated paperboard sheet feeding apparatus according to one embodiment of the present invention.

First of all, with reference to FIG. 1, an overall configuration of a corrugated paperboard box making machine employing a corrugated paperboard sheet feeding apparatus according to one embodiment of the present invention will be described. FIG. 1 is a schematic side view depicting an entirety of the corrugated paperboard box making machine employing a corrugated paperboard sheet feeding apparatus according to one embodiment of the present invention.

As depicted in FIG. 1, the corrugated paperboard box making machine 100 comprises: a corrugated paperboard sheet feeding apparatus PF (hereinafter written as "corrugated paperboard sheet feeding apparatus 1" on a case-by-case basis) for feeding out a plurality of corrugated paperboard sheets SH stacked in an up-down direction, one-by-one; a printing apparatus PR for performing a printing on the corrugated paperboard sheet SH fed out by the corrugated paperboard sheet feeding apparatus 1; a creaser-slotter CS for forming a crease, a slot and a joint flap on the corrugated paperboard sheet SH printed by the printing apparatus PR; and a die cutter DC for forming a punched-out portion having a given shape in the corrugated paperboard sheets SH processed by the creaser-slotter CS.

The corrugated paperboard sheet feeding apparatus 1 comprises a suction box 2 as a housing. A plurality of corrugated paperboard sheets SH produced by a corrugator (not depicted) are stacked on a table 2*b* defining an upper surface of the suction box 2 while being guided between a front gate 13 and a back guide 14. The front gate 13 is disposed to allow the stacked corrugated paperboard sheets SH to be fed out one-by-one through a gap between the table 2*b* and the front gate 13. The back guide 14 is configured to be movable with respect to the front gate 13 in a direction parallel to a feed-out direction FD, so as to receive a plurality of types of corrugated paperboard sheets SH having different lengths in the feed-out direction FD. The suction box 2 is provided with a suction device 17 (only a portion thereof is depicted in FIG. 1) connected to a lower portion thereof, in such a manner that internal air of the suction box 2 can be suctioned (sucked out) by the suction device 17.

The corrugated paperboard sheet feeding apparatus 1 further comprises: a plurality of sheet feeding rollers 3 arranged along the feed-out direction FD and a direction orthogonal to the feed-out direction FD; and a grate 4 serving as an elevating member (raisable-lowerable member) formed of a plate-shaped member extending along the feed-out direction FD and the direction orthogonal to the feed-out direction FD and configured to be raised and lowered with respect to the sheet feeding rollers 3. The plurality of sheet feeding rollers and the grate 4 are provided in an upper region of the suction box 2 to define a part of the upper surface of the suction box 2. When the grate 4 is lowered beyond an uppermost portion of the sheet feeding rollers 3, the plurality of sheet feeding rollers 3 come into contact with a lowermost one of the corrugated paperboard sheets SH, so that rotation of the sheet feeding rollers 3 is transmitted to the lowermost corrugated paperboard sheet SH and thereby the lowermost corrugated paperboard sheet SH is fed out toward a feed roller pair 10 located immediately forward. In this case, when the corrugated paperboard sheet SH fed out by the sheet feeding rollers 3 reaches the feed roller pair 10, the feed roller pair 10 further feeds the corrugated paperboard sheet SH toward a printing apparatus PR located immediately forward of the feed roller pair 10. On the other hand, when the grate 4 is raised beyond the sheet feeding rollers 3, the sheet feeding rollers 3 are kept in a non-contact state with respect to the lowermost corrugated paperboard sheet SH, so that rotation of the sheet feeding rollers 3 is not transmitted to the lowermost corrugated paperboard sheet SH. The feed roller pair 10 is configured to be driven by a main drive motor MT (not depicted).

The printing apparatus PR comprises two printing units 40, 41. Each of the printing units 40, 41 comprises: a printing cylinder (40A, 41A), so-called "plate cylinder"; a printing plate member; an ink applicator; and a pressure roller. The printing plate member is attached to an outer peripheral surface of the printing cylinder (40A, 41A). The ink applicator comprises an inking roller for applying ink having a color which is different in each of the printing units 40, 41. The printing apparatus PR is configured to perform two-color printing of the corrugated paperboard sheet SH by using the two printing units 40, 41, and supply the printed corrugated paperboard sheet SH to the creaser-slotter CS. Each of the printing units 40, 41 is configured to be driven by the main drive motor MT (not depicted).

The creaser-slotter CS comprises one creaser unit 60, and two slotter units 61, 62. The creaser unit 60 is equipped with a pair of creasing rollers arranged one above the other, as a mechanism for performing creasing. Each of the slotter units 61, 62 is equipped with an upper slotter to which a slotter blade is attached, and a lower slotter formed with a groove fittable with the slotter blade, as a mechanism for performing slotting. The creaser-slotter CS is configured to form a crease, a slot and a joint flap on the printed corrugated paperboard sheet SH by using the creaser unit 60 and the slotter units 61, 62, and then supply the processed corrugated paperboard sheet SH to the die cutter DC. Each of the creaser unit 60 and the slotter units 61, 62 is configured to be driven by the main drive motor MT (not depicted).

The die cutter DC comprises a die cylinder 80 and an anvil cylinder 81 which are disposed across a conveyance path. A punching die 82 for punching a cutout in the processed corrugated paperboard sheet SH is attached to a plate-like body made of veneer-core plywood or the like, and the plate-like body with the punching die 82 is wound around an outer peripheral surface of the die cylinder 80. Thus, the punching die 82 is operable to punch a cutout in the processed corrugated paperboard sheet SH being continuously conveyed, at a desired position. During order change, the punching die 82 can be replaced with another punching die having a punching pattern conforming to a new order. Each of the die cylinder 80 and the anvil cylinder 81 is configured to be driven by the main drive motor MT (not depicted).

<Configuration of Corrugated Paperboard Sheet Feeding Apparatus>

With reference to FIGS. 2 to 4B, a specific configuration of the corrugated paperboard sheet feeding apparatus 1 according to this embodiment will be described.

Figure 2:
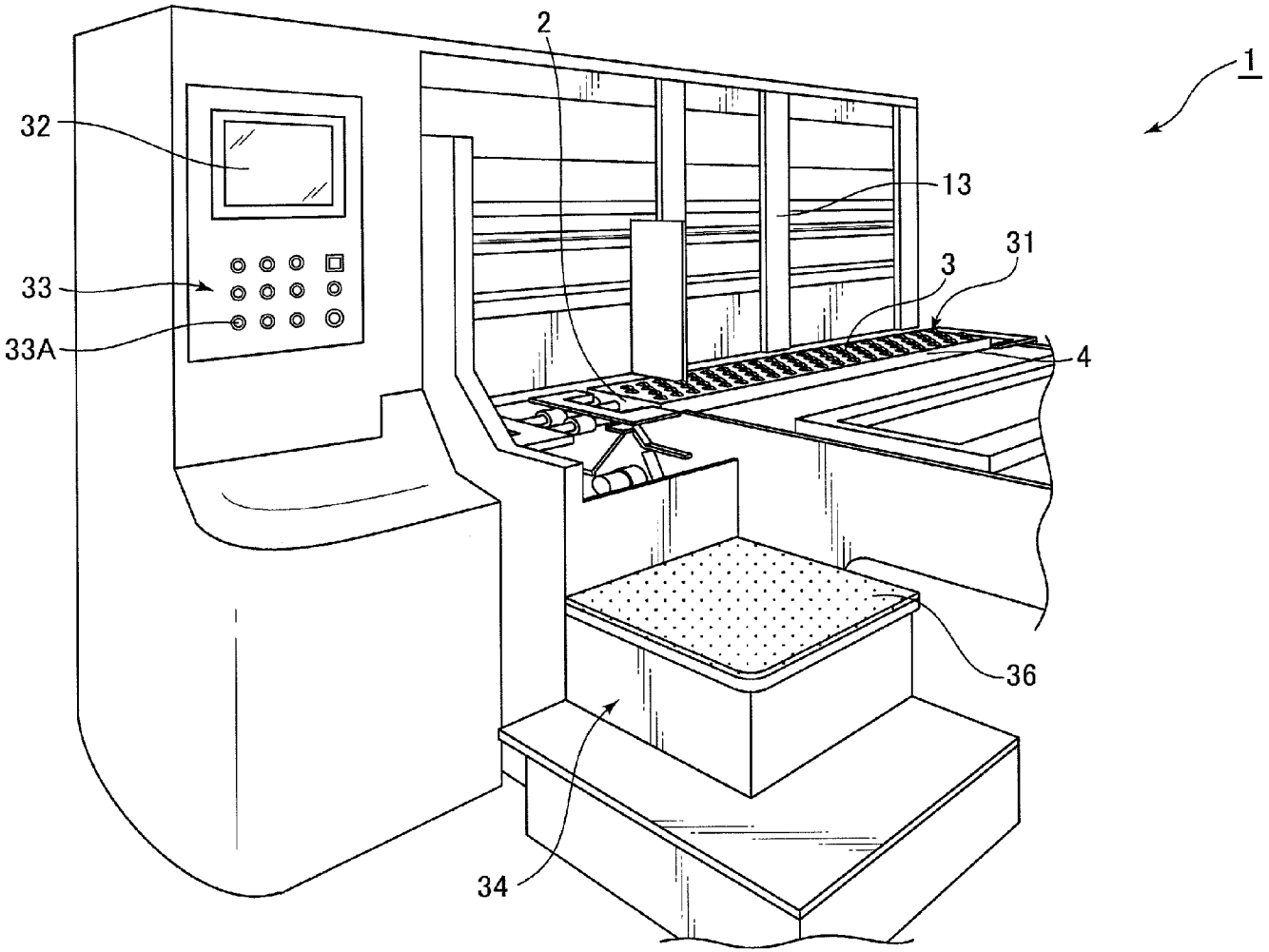
FIG. 2 is a perspective view schematically depicting an external appearance of the corrugated paperboard sheet feeding apparatus according to this embodiment.

FIG. 2 is a perspective view schematically depicting an external appearance of the corrugated paperboard sheet feeding apparatus 1 according to this embodiment. As depicted in FIG. 2, the corrugated paperboard sheet feeding apparatus 1 has a sheet feeding section 31, i.e., a section for feeding the lowermost corrugated paperboard sheet SH, including the plurality of sheet feeding rollers 3 and the grate 4 which are provided in the upper region of the suction box 2. In the corrugated paperboard sheet feeding apparatus 1, a worker can walk up steps 34 to perform work with respect to the corrugated paperboard sheets SH, in the sheet feeding section 31. For example, the worker performs the work of aligning edges of the corrugated paperboard sheets SH placed on the sheet feeding section 31, or the work of correcting a jamming in the corrugated paperboard sheets SH placed on the sheet feeding section 31. In the corrugated paperboard sheet feeding apparatus 1, an area around the worker who has walked up the steps 34 is one example of an area for performing work in the sheet feeding section 31.

Further, the corrugated paperboard sheet feeding apparatus 1 comprises a mat switch 36 provided on a floor surface of an uppermost one of the steps 34, i.e., in a site on which the worker stands when he/she performs work in the sheet feeding section 31, to serve as a human detecting device. The mat switch 36 is constructed by arranging a plurality of tape switches. More specifically, the mat switch 36 is configured such that, when a load is applied to a rubber plate on a top thereof, an internal switch element is pressed through the rubber plate, and thus contacts of the switch element are closed to turn on the mat switch 36. The corrugated paperboard sheet feeding apparatus 1 is configured such that, when the mat switch 36 is turned on during operation thereof, respective movements of the sheet feeding rollers 3 and the grate 4 are stopped, as described in detail later.

Further, the corrugated paperboard sheet feeding apparatus 1 comprises a display 32 for displaying settings and an operational state of the corrugated paperboard sheet feeding apparatus 1, and a plurality of manual operation buttons 33 for performing manipulations or the like with respect to the corrugated paperboard sheet feeding apparatus 1. Specifically, the manual operation buttons 33 include a release button 33A for, in a situation where the movements of the sheet feeding rollers 3 and the grate 4 are stopped in response to turn-on of the mat switch 36, as mentioned above, releasing the stopped state of the sheet feeding rollers 3 and the grate 4. Preferably, in order to allow the movements of the sheet feeding rollers 3 and the grate 4 to be restarted only when a worker moves away from the vicinity of the sheet feeding section 31, it is desirable to provide the release button 33A at a position which is beyond the reach of the worker when he/she stands on the uppermost step 34, i.e., at a position which is within the reach of the worker only when he/she walks down the steps 34.

The display 32 may be constructed as a touch panel, and a virtual release button may be displayed on such a type of display 32. In other words, a virtual button functioning as the above release button may be displayed on the display 32 constructed as a touch panel.

Figure 3:
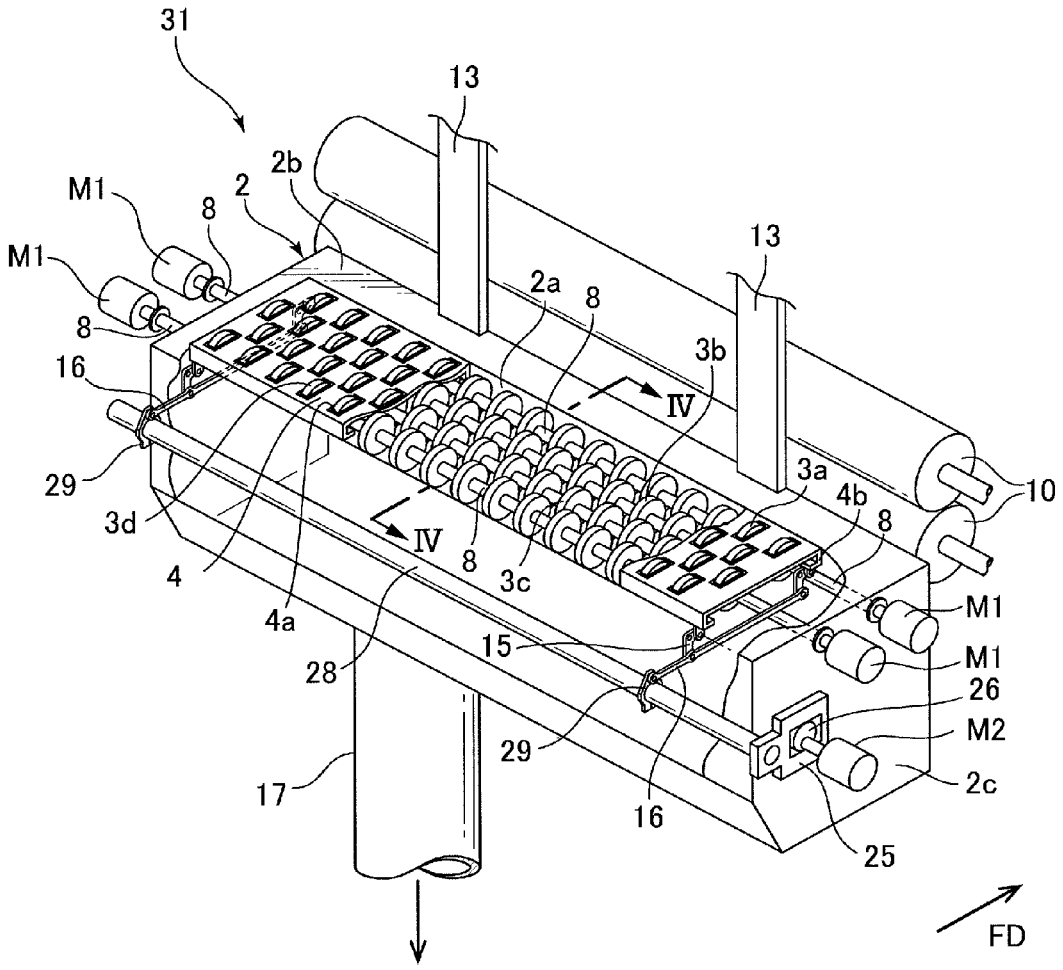
FIG. 3 is a perspective view depicting a sheet feeding section and others of the corrugated paperboard sheet feeding apparatus according to this embodiment.
Figure 4A:
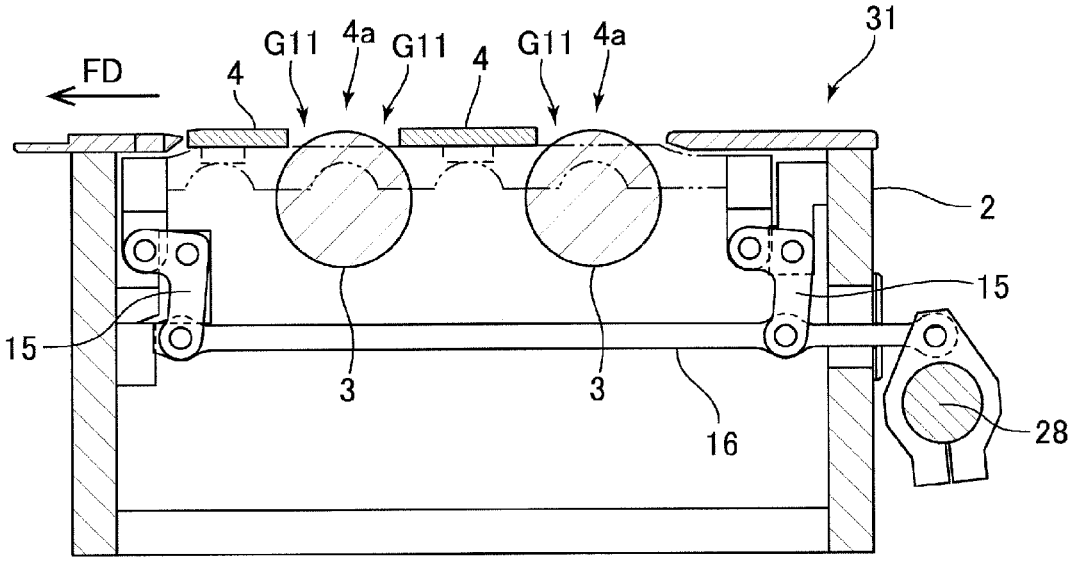
FIGS. 4A and 4B are sectional views of the sheet feeding section of the corrugated paperboard sheet feeding apparatus according to this embodiment, taken along the line IV-IV in FIG. 3.
Figure 4B:
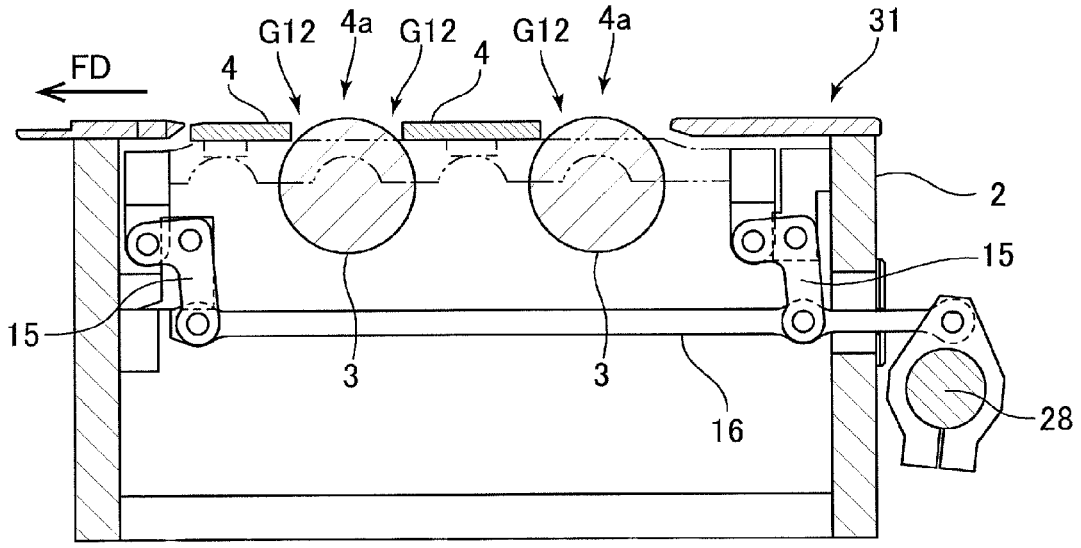

With reference to FIGS. 3, 4A and 4B, a detailed configuration of the sheet feeding section 31 (section including the suction box 2, the sheet feeding rollers 3 and the grate 4) of the corrugated paperboard sheet feeding apparatus 1 according to this embodiment will be described below.

FIG. 3 is a perspective view depicting the sheet feeding section 31 and others of the corrugated paperboard sheet feeding apparatus 1 according to this embodiment. In this figure, the suction box 2 is partially cut away to depict components in a see-through manner. FIGS. 4A and 4B are sectional views of the sheet feeding section 31 of the corrugated paperboard sheet feeding apparatus 1 according to this embodiment, taken along the line IV-IV in FIG. 3 (line orthogonal to the feed-out direction FD). Specifically, FIG. 4A depicts a state in which the grate 4 is at a raised position (which means a position where the grate 4 is raised to an uppermost position. The same applies to the following), and FIG. 4B depicts a state in which the grate 4 is at a lowered position (which means a position where the grate 4 is lowered to a lowermost position. The same applies to the following). Primarily with reference to FIG. 3 and supplementarily with reference to FIGS. 4A and 4B, the sheet feeding section 31 in this embodiment will be described here.

As depicted in FIG. 3, the suction box 2 is formed as a housing by right and left sidewalls 2*c*, the table 2*b* defining a part of the upper surface (loading surface) and others, wherein the suction box 2 is provided with the suction device 17 (only a portion thereof is depicted in FIG. 1) connected to the lower portion thereof, and configured to suck the corrugated paperboard sheet SH (see FIG. 1) placed on the table 2*b* downwardly. The front gate 13 is disposed on a downstream side of the suction box 2 to extend vertically upwardly. The front gate 13 is configured to be positionally adjustable in the up-down direction to allow a distance between a lower edge of the front gate 13 and the table 2*b* of the suction box 2 to be adjusted in conformity to a thickness of the corrugated paperboard sheet SH. The feed roller pair (pair of upper and lower feed rollers) 10 is provided on the downstream side of the suction box 2 along a height position of the upper surface of the suction box 2. A plurality of corrugated paperboard sheets SH are placed on the table 2*b* of the suction box 2 in a stacked manner (see FIG. 1), and fed out one-by-one in order from the lowermost one thereof, whereafter the fed-out corrugated paperboard sheet SH is introduced between the pair of feed rollers 10 driven synchronously.

The suction box 2 may be configured such that an internal space thereof is divided into a plurality of sub-spaces arranged side-by-side in a lateral direction (direction orthogonal to the feed-out direction FD) by a plurality of partition walls, and suctioning by the suction device 17 is applied to only a part of the sub-spaces of the suction box 2, without applying the suctioning by the suction device 17 to the remaining sub-spaces of the suction box 2. In case of feeding out a corrugated paperboard sheet SH having a relatively small width, such a partitioning structure is preferably employed in the internal space of the suction box 2 to thereby allow the suctioning by the suction device 17 to be applied to only a part of the sub-spaces of the suction box 2 corresponding to a region of the upper wall of the suction box 2 on which the corrugated paperboard sheet SH is placed, without being applied to the remaining sub-spaces corresponding to a region of the upper wall of the suction box 2 on which the corrugated paperboard sheet SH is not placed.

In the upper region of the suction box 2, there is provided the plurality of sheet feeding rollers 3 (3*a*, 3*b*, 3*c*. 3*d*) for feeding out a lowermost one of the stacked corrugated paperboard sheets SH toward the feed roller pair 10, and the grate 4 for adjusting an upward protruding amount with respect to the plurality of sheet feeding rollers 3, based on the upward and downward (rising and lowering) movements thereof, to thereby control contact and non-contact of the plurality of sheet feeding rollers 3 with respect to the lowermost corrugated paperboard sheet SH. Specifically, the suction box 2 has an opening portion 2*a* formed in the table 2*b*, and the plurality of sheet feeding rollers 3 and the grate 4 are disposed in the opening portion 2*a*. A plurality of servomotors M1 for driving a plurality of sets of sheet feeding rollers 3, respectively (the servomotors M1 will hereinafter be referred to as "sheet feeding roller servomotors M1" on a case-by-case basis) and a servomotors M2 for driving the grate 4 (the servomotor M2 will hereinafter be referred to as "grate servomotor M2" on a case-by-case basis) are disposed on lateral sides of the suction box 2.

The plurality of sets of sheet feeding rollers 3 are attached, respectively, to a plurality of drive shafts 8 each disposed between the sidewalls 2*c* of the suction box 2. Specifically, the plurality of drive shafts 8 are arranged at even intervals, and the sheet feeding rollers 3 in each set are formed to have the same diameters and disposed on a corresponding one of the drive shafts 8 at even intervals. The sheet feeding roller servomotors M1 are coupled, respectively, to ends of the drive shafts 8 each provided with the set of sheet feeding rollers 3. In the embodiment depicted in FIG. 3, the corrugated paperboard sheet feeding apparatus 1 comprises four drive shafts 8, wherein four sheet feeding roller servomotors M1 are coupled, respectively, to the drive shafts 8 so as to rotationally drive the four drive shafts 8, independently. That is, four sets of sheet feeding rollers 3 (3*a*, 3*b*, 3*c*, 3*d*) each attached to a respective one of the four drive shafts 8 can be rotationally driven, independently. According to the rising and lowering movements of the grate 4, each of the plurality of sheet feeding rollers 3 can be located to protrude upwardly from the grate 4 through a corresponding one of the opening portions 4*a* of the grate 4, to appear from the opening portion 2*a* of the suction box 2 (see FIG. 4B), and can be located below the grate 4 (see FIG. 4A).

The grate 4 is a plate-shaped member disposed in the opening portion 2*a* of the suction box 2. The grate 4 has a plurality of opening portions 4*a* each formed to penetrate therethrough so as to receive therein a respective one of the sheet feeding rollers 3 (3*a*, 3*b*, 3*c*, 3*d*) while avoiding contact with the sheet feeding roller 3, during rising and lowering of the grate 4. The plate-shaped grate 4 is coupled to a pivot shaft 28 through a link mechanism such as four L-shaped members 15 arranged, respectively, around four corners thereof, and two arms 16. Specifically, two angular C-shaped hooks 4*b* are formed, respectively, at longitudinally opposite ends of the plate-shaped grate 4, and the L-shaped members 15 and the arm 16, acting as a means to generate rising and lowering movements, is coupled to the grate 4 through the hooks 4*b*.

In this embodiment, the grate 4 is formed as a single plate-shaped member. However, the present invention is not limited thereto, but a surface of the grate 4 which is to be brought onto contact with the lowermost corrugated paperboard sheet SH may be formed of a separate member (e.g., a wearing plate). In the case of using such a separate member, the entire plate-shaped laminate comprising the separate member makes up the grate 4.

A swingable member 25 is attached to one end of the pivot shaft 28 of the grate 4, and an eccentric cam 26 is attached to the swingable member 25. The grate servomotor M2 is attached to the eccentric cam 26. The eccentric cam 26 is formed in a circular shape, and configured to be rotated about a rotational axis eccentric with respect to a rotational axis of the grate servomotor M2. Thus, the swingable member 25 is configured to be swingably moved about the pivot shaft 28 according to the movement of the eccentric cam 26. Then, the swing motion of the swingable member 25 is transmitted to the pivot shaft 28. The pivot shaft 28 is coupled to the arms 16 disposed below the grate 4, through respective connectors 29. Each of the arms 16 is disposed below the grate 4 to become parallel to the feed-out direction FD of the corrugated paperboard sheets SH, and coupled to the grate 4 through corresponding two of the L-shaped members 15 disposed around the four corners of the grate 4. When the alms 16 are moved in the feed-out direction FD according to rotation of the pivot shaft 28, one end of each of the L-shaped members 15 coupled to the grate 4 is pushed upwardly, so that the grate 4 is raised (see FIG. 4A). On the other hand, when the arms 16 are moved in a direction opposite to the feed-out direction FD, according to the rotation of the pivot shaft 28, the one end of each of the L-shaped members 15 coupled to the grate 4 is pushed downwardly, so that the grate 4 is lowered (see FIG. 4B).

Figure 5:
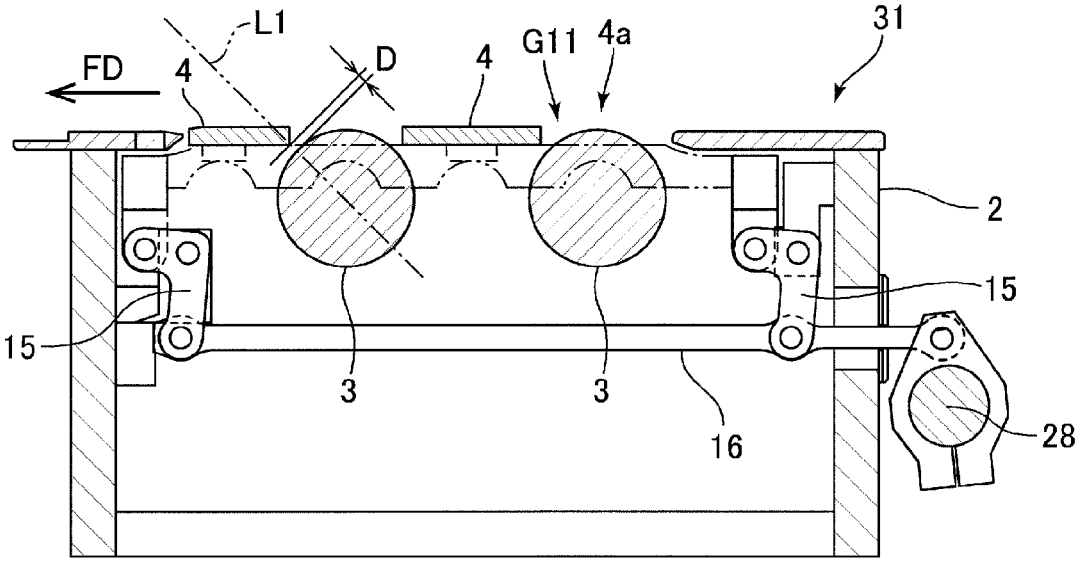
FIG. 5 is an explanatory diagram of a gap distance between each of a plurality of sheet feeding rollers and a corresponding one of a plurality of opening portions of a grate in this embodiment.

With reference to FIG. 5 in addition to FIGS. 4A and 4B, the following discussion will be made with respect to a gap between each of the sheet feeding rollers 3 and a corresponding one of the opening portions 4*a* of the grate 4. FIG. 5 is a view depicting the same state as that in FIG. 4A, for explanting a gap distance between each of the sheet feeding rollers 3 and a corresponding one of the opening portions 4*a* of the grate 4.

The reference sign G11 in FIG. 4A indicates a gap between each of the sheet feeding rollers 3 and a corresponding one of the opening portions 4*a* of the grate 4, at the raised position of the grate 4, and the reference sign G12 in FIG. 4B indicates a gap between each of the sheet feeding rollers 3 and a corresponding one of the opening portions 4*a* of the grate 4, at the lowered position of the grate 4. In this embodiment, the gap between each of the sheet feeding rollers 3 and a corresponding one of the opening portions 4*a* of the grate 4 is defined as a gap between an outer peripheral edge of each of the sheet feeding rollers 3 and an inner peripheral edge of a corresponding one of the opening portions 4*a* of the grate 4. Further, as depicted in FIG. 5, the gap distance D between each of the sheet feeding rollers 3 and a corresponding one of the opening portions 4*a* of the grate 4 is defined as a distance between an outer peripheral edge of each of the sheet feeding rollers 3 and an inner peripheral edge of a corresponding one of the opening portions 4*a* of the grate 4, when viewed in a cross-section taken along the feed-out direction FD. More specifically, the gap distance D is defined as a distance between a first point on the outer peripheral edge of each of the sheet feeding rollers 3 and a second point on the inner peripheral edge of a corresponding one of the opening portions 4*a* of the grate 4, when viewed in a cross-section taken along the feed-out direction FD, wherein the first and second points are located on a straight line L1 passing through a center of a circular cross-section of the sheet feeding roller 3. As the grate 4 is gradually raised, the grate 4 comes away from the sheet feeding rollers 3 (see FIG. 4A). On the other hand, as the grate 4 is gradually lowered, the grate 4 comes close to the sheet feeding rollers 3 (see FIG. 4B). That is, the gap distance D changes depending on an up-down position of the grate 4. Specifically, the gap distance D of the gap G12 at the lowered position of the grate 4 as depicted in FIG. 4B is smaller than that of the gap G11 at the raised position of the grate 4 as depicted in FIG. 4A. For applying a downward suction force to the lowermost corrugated paperboard sheet, a gap having a gap distance of about 3 mm is provided between a lateral surface of each of the sheet feeding rollers 3, and an inner peripheral edge of a corresponding one of the opening portions 4*a* of the grate 4 parallel to the feed-out direction FD. However, this gap distance is constant, irrespective of the up-down position of the grate 4.

As mentioned above, the grate 4 is formed with the plurality of opening portions 4*a* each capable of allowing a corresponding one of the sheet feeding rollers 3 to pass therethrough while avoiding contact with the grate 4 during rising and lowering of the grate 4. From this point of view, basically, a size allowing the outer peripheral edge of the sheet feeding roller 3 and the inner peripheral edge of the corresponding opening portion 4*a* to be kept apart from each other during rising and lowering of the grate 4, particularly a size allowing a non-contact state between the outer peripheral edge of the sheet feeding roller 3 and the inner peripheral edge of the corresponding opening portion 4*a* to be ensured at the lowermost position of the grate 4, is employed in each of the opening portions 4*a* of the grate 4. In this embodiment, a length of each of the opening portions 4*a* of the grate 4 along the feed-out direction FD is set to a value as small as possible, while complying with the above restriction on the size of the opening portion 4*a* of the grate 4. This makes it possible to minimize the gap distance D between each of the sheet feeding rollers 3 and a corresponding one of the opening portions 4*a* of the grate 4.

Specifically, in this embodiment, the gap distance D between each of the sheet feeding rollers 3 and a corresponding one of the opening portions 4*a* of the grate 4 is set to 10 mm or less. More preferably, the gap distance D between each of the sheet feeding rollers 3 and a corresponding one of the opening portions 4*a* of the grate 4 is set to 5 mm or less. For example, in the case where the grate 4 is raised or lowered over a distance of about 4 mm, the grate 4 is configured such that the gap distance D in the gap G11 between the sheet feeding roller 3 and the corresponding opening portion 4*a* at the raised position of the grate 4 becomes about 5 mm, and the gap distance D in the gap G12 between the sheet feeding roller 3 and the corresponding opening portion 4*a* at the lowered position of the grate 4 becomes about 2.5 mm.

<Configuration of Control Device>

Figure 6:
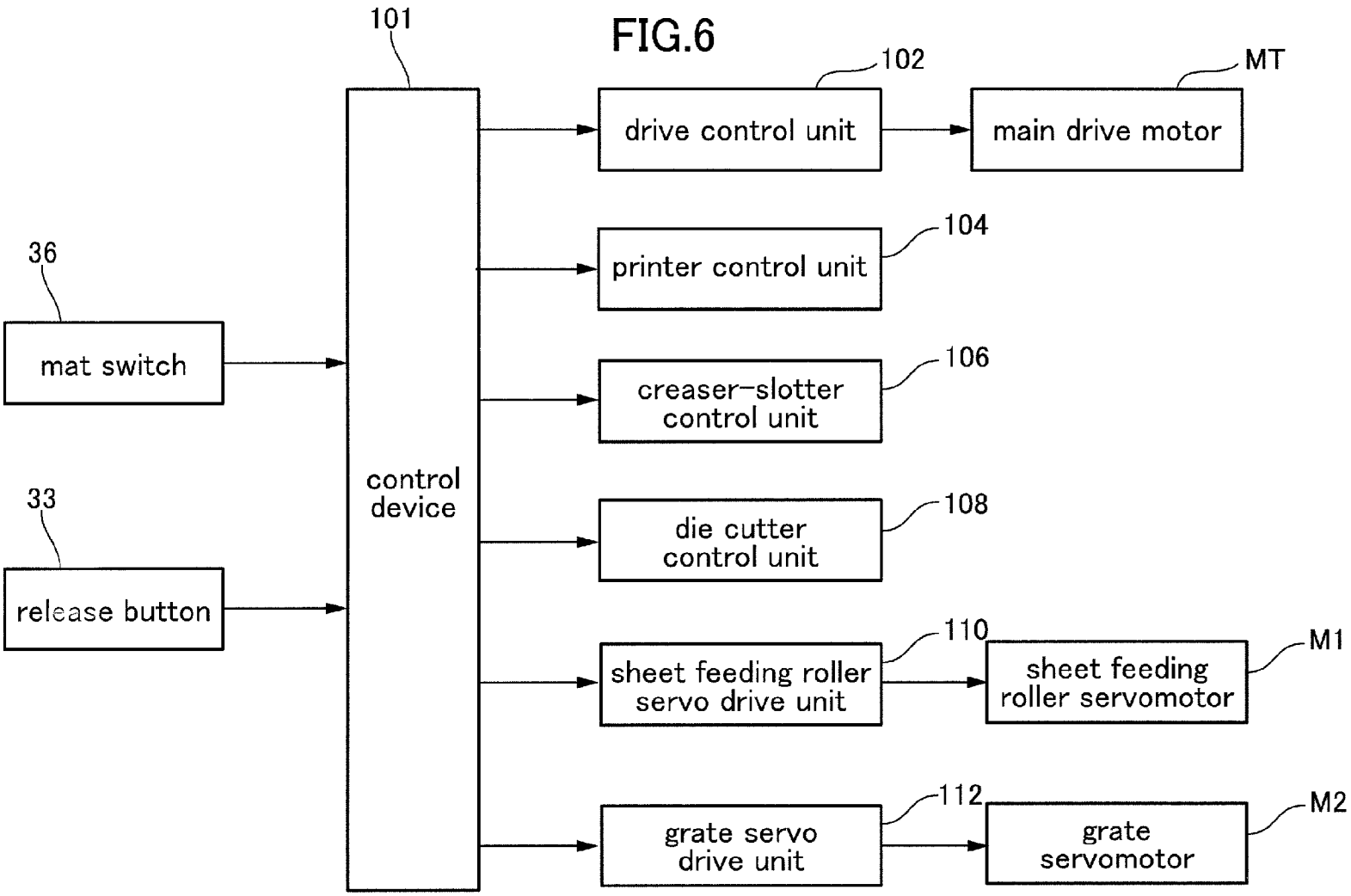
FIG. 6 is a block diagram depicting an electrical configuration of the corrugated paperboard box making machine employing the corrugated paperboard sheet feeding apparatus according to this embodiment.

With reference to FIG. 6, a control system configuration of the corrugated paperboard box making machine 100 (see FIG. 1) employing the corrugated paperboard sheet feeding apparatus 1 according to this embodiment will be described below. FIG. 6 is a block diagram depicting an electrical configuration of the corrugated paperboard box making machine 100 employing the corrugated paperboard sheet feeding apparatus 1 according to this embodiment.

As depicted in FIG. 6, the corrugated paperboard box making machine 100 is configured to be controlled by a control device 101. Specifically, the control device 101 is operable to control the main drive motor MT connected to the feed roller pair 10 of the corrugated paperboard sheet feeding apparatus 1, the printing units 40, 41 of the printing apparatus PR, the creaser unit 60 and the slotter units 61, 62 of the creaser-slotter CS, and the die cylinder 80 and the anvil cylinder 81 of the die cutter DC (see FIG. 1), through a drive control unit 102. In addition, the control device 101 is operable to: control respective operations of the printing units 40, 41 of the printing apparatus PR, through a printer control unit 104; control respective operations of the creaser unit 60 and the slotter units 61, 62 of the creaser-slotter CS, through a creaser-slotter control unit 106; and control operation of the die cutter DC (see FIG. 1), through a die cutter control unit 108.

As to the corrugated paperboard sheet feeding apparatus 1, the control device 101 is also operable to control the sheet feeding roller servomotors M1 through a sheet feeding roller servo drive unit 110 to thereby control rotational movements of the sheet feeding rollers 3 coupled, respectively, to the sheet feeding roller servomotors M1 through the drive shafts 8. More specifically, the plurality of sheet feeding roller servomotors M1 are coupled, respectively, to the plurality of sets of sheet feeding rollers 3 (see FIG. 3), and the control device 101 is operable to control each of the plurality of sheet feeding roller servomotors M1 through the sheet feeding roller servo drive unit 110 to thereby control a rotational movement of each of the sets of sheet feeding rollers 3, independently. Further, as to the corrugated paperboard sheet feeding apparatus 1, the control device 101 is operable to control the grate servomotor M2 through a grate servo drive unit 112 to thereby control the rising and lowering movements of the grate 4 coupled to the grate servomotor M2 through the eccentric cam 26, the swingable member 25, the pivot shaft 28, the arms 16 and the L-shaped members 15 (see FIG. 3). Further, the control device 101 is configured to receive an input of signals, primarily, from the mat switch 36 and the release button 33A of the corrugated paperboard sheet feeding apparatus 1.

The control device 101 is operable, based on the signals from the mat switch 36 and the release button 33A, to perform control of the sheet feeding roller servomotors M1 through the sheet feeding roller servo drive unit 110, and control of the grate servomotor M2 through the grate servo drive unit 112. Particularly, in this embodiment, the control device 101 is operable, when the mat switch 36 is turned on during operation of the corrugated paperboard sheet feeding apparatus 1, to stop driving of the sheet feeding roller servomotors M1 and the grate servomotor M2 to thereby stop the movements of the sheet feeding rollers 3 and the grate 4. In this situation, the control device 101 is operable to maintain driving of the drive control unit 102, the printer control unit 104, the creaser-slotter control unit 106 and the die cutter control unit 108. That is, the control device 101 operates to stop the operation of the corrugated paperboard sheet feeding apparatus 1, but keep operations of the printing apparatus PR, the creaser-slotter CS and the die cutter DC to thereby perform processing for a corrugated paperboard sheet SH which has already been fed out from the corrugated paperboard sheet feeding apparatus 1. Further, in this embodiment, in the situation where the movements of the sheet feeding rollers 3 and the grate 4 of the corrugated paperboard sheet feeding apparatus 1 are stopped, when the mat switch 36 is changed from an ON state to an OFF state, and the release button 33A is turned on, the control device 101 is operable to release the stopped state of the sheet feeding rollers 3 and the grate 4 to restart the driving of the sheet feeding roller servomotors M1 and the grate servomotor M2 through the sheet feeding roller servo drive unit 110 and the grate servo drive unit 112 so as to restart the movements of the sheet feeding rollers 3 and the grate 4.

Figure 7:
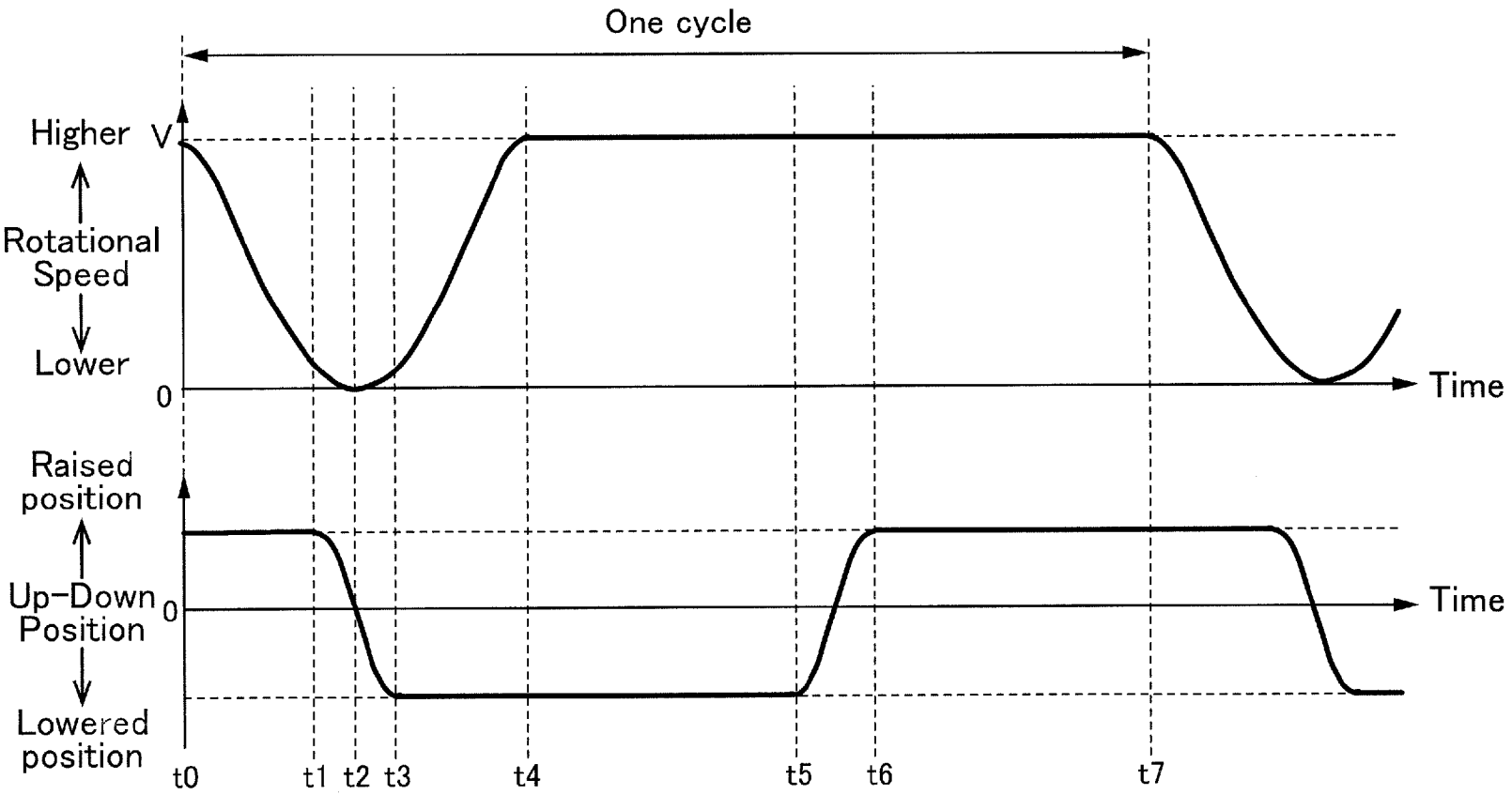
FIG. 7 is a time chart depicting a basic control to be executed for the sheet feeding rollers and the grate by a control device in this embodiment.

With reference to FIG. 7, a basic control to be executed for the sheet feeding rollers 3 and the grate 4 by the control device 101 will be described below. In FIG. 7, a temporal change in rotational speed of the sheet feeding rollers 3 is depicted on an upper side, and a temporal change in up-down position of the sheet feeding roller 3 is depicted on a lower side. As above, the control device 101 is operable to control the rotational speed of the sheet feeding rollers 3 through the sheet feeding roller servo drive unit 110 and the sheet feeding roller servomotors M1, and control the up-down position of the grate 4 through the grate servo drive unit 112 and the grate servomotor M2 (see FIG. 6).

First of all, at time t0, the sheet feeding rollers 3 are rotated at a given rotational speed V, and the grate 4 is at the raised position. From the time t0, the control device 101 starts a control operation for feeding out a lowermost one of the stacked corrugated paperboard sheets SH. Specifically, from the time t0, the control device 101 operates to gradually reduce the rotational speed of the sheet feeding rollers 3, i.e., rotationally decelerate the sheet feeding rollers 3, while maintaining the grate 4 at the raised position. Subsequently, from time t1 when the rotational speed of the sheet feeding rollers 3 is fairly reduced, the control device 101 operates to start to lower the grate 4 located at the raised position. Then, at time t2, the grate 4 reaches a reference position (which is an intermediate position between the raised position and the lower position, and is defined as a "0" position in FIG. 7), and the rotational speed of the sheet feeding rollers 3 becomes approximately zero. From the time t2, the control device 101 operates to gradually increase the rotational speed of the sheet feeding rollers 3, i.e., rotationally accelerate the sheet feeding rollers 3.

Subsequently, at time t3, the grate 4 reaches the lowered position, and, from the time t3, the control device 101 operates to maintain the grate 4 at the lowered position. When the grate 4 is at the lowered position, each of the sheet feeding rollers 3 protrudes upwardly from a corresponding one of the opening portions 4*a*, and comes into contact with a lowermost one of the stacked corrugated paperboard sheets SH, so that the lowermost corrugated paperboard sheet SH is fed out by the sheet feeding rollers 3. Then, at time t4, the rotational speed of the sheet feeding rollers 3 reaches a given value V, and, from the time t4, the control device 101 operates to stop the acceleration of the sheet feeding rollers 3 and maintain the sheet feeding rollers 3 at the given rotational speed V. The given rotational speed V is approximately equal to a rotational speed of the feed roller pair 10. Thus, the sheet feeding rollers 3 and the feed roller pair 10 are synchronously rotated, and, when the corrugated paperboard sheet SH fed out according to rotation of the sheet feeding rollers 3 reaches the feed roller pair 10 disposed downstream of the sheet feeding rollers 3 after the time t4, the sheet feeding rollers 3 and the feed roller pair 10 cooperate with each other to further feed out the corrugated paperboard sheet SH toward the downstream side (specifically toward the printing apparatus PR).

Subsequently, at time t5, the control device 101 operates to start to raise the grate 4 located at the lowered position. Then, at time t6, the grate 4 reaches the raised position, and, from the time t6, the control device 101 operates to maintain the grate 4 at the raised position. When the grate 4 is at the raised position, the sheet feeding rollers 3 are located below the grate 4, so that the sheet feeding rollers 3 are kept in a non-contact state with respect to the lowermost corrugated paperboard sheet SH. This makes it possible to suppress the occurrence of a situation where, before the completion of feed-out of the lowermost corrugated paperboard sheet SH (current target corrugated paperboard sheet SH to be fed out) from the corrugated paperboard sheet feeding apparatus 1, the second-lowermost corrugated paperboard sheet SH (next target corrugated paperboard sheet SH to be fed out) is displaced due to contact with the sheet feeding rollers 3. Subsequently, at time t7, the control device 101 operates to gradually reduce the rotational speed of the sheet feeding rollers 3 in the same manner at the time t0. That is, from the time t7, the control device 101 starts a control operation for feeding out the next lowermost corrugated paperboard sheet SH.

In the above control operation, a period from the time t0 to the time t7 in FIG. 7 corresponds to one operation cycle of the sheet feeding rollers 3 and the grate 4 for feeding out the lowermost corrugated paperboard sheet SH (lowermost one of the stacked corrugated paperboard sheets SH) according to the movements of the sheet feeding rollers 3 and the grate 4. In this embodiment, when the mat switch 36 is turned on during operation of the corrugated paperboard sheet feeding apparatus 1, the control device 101 operates to stop the movements of the sheet feeding rollers 3 and the grate 4, as mentioned above. In this case, the control device 101 operates to stop the movements of the sheet feeding rollers 3 and the grate 4 at a timing when the one operation cycle of the sheet feeding rollers 3 and the grate 4 is completed, instead of stopping the movements of the sheet feeding rollers 3 and the grate 4 immediately after the mat switch 36 is turned on. That is, the control device 101 operates to prevent the movements of the sheet feeding rollers 3 and the grate 4 from being stopped, until the one operation cycle of the sheet feeding rollers and the elevating member is completed. This makes it possible to suppress the occurrence of defective feed-out of a corrugated paperboard sheet SH and defective processing (e.g., defective printing) on the downstream side of the corrugated paperboard sheet feeding apparatus 1.

<Control Flow>

Figure 8:
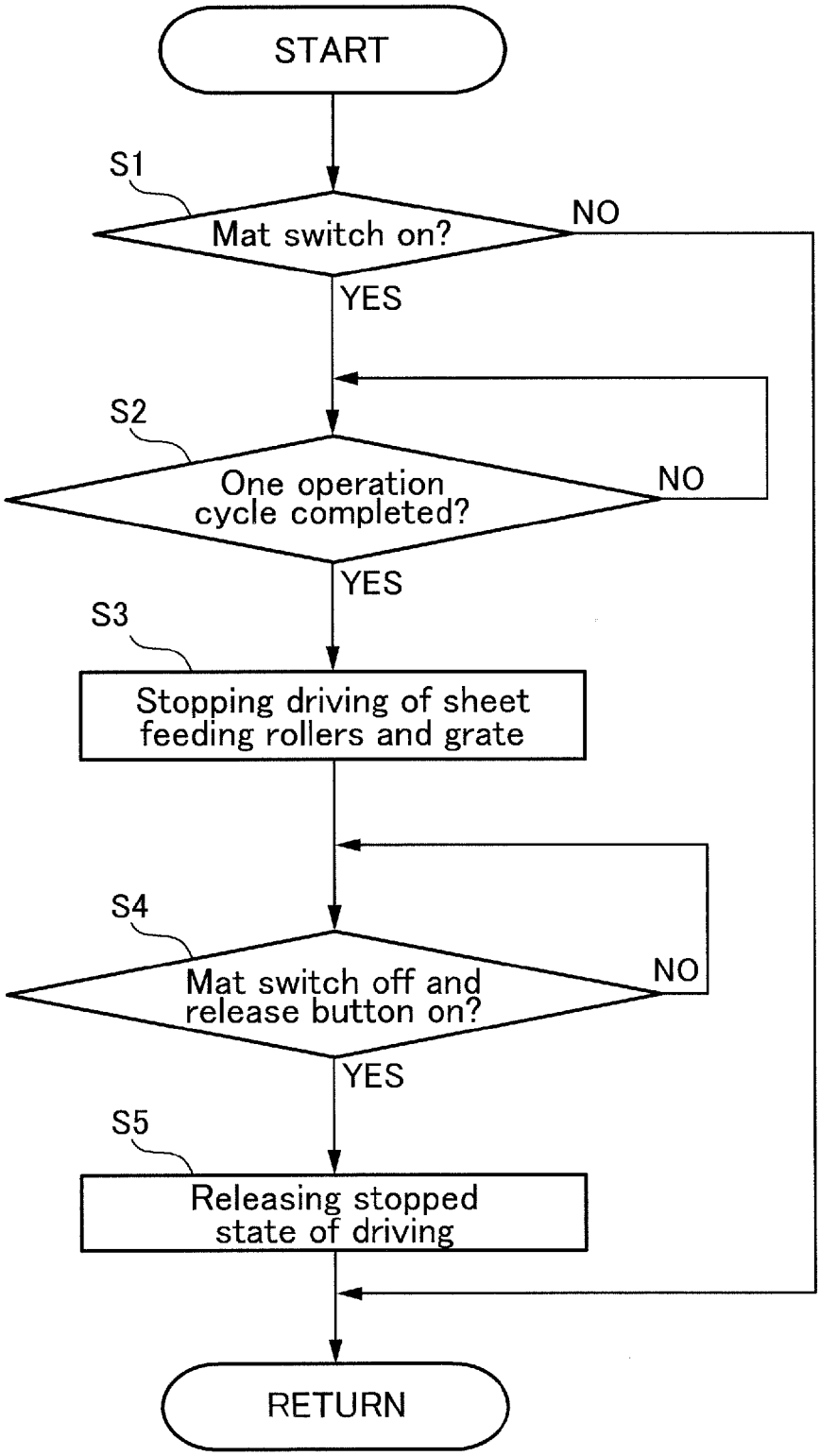
FIG. 8 is a flow chart depicting a stop control for the sheet feeding rollers and the grate in this embodiment.

With reference to FIG. 8, a stop control to be executed for the sheet feeding rollers 3 and the grate 4 by the control device 101 in this embodiment will be described below. FIG. 8 is a flow chart depicting a stop control for the sheet feeding rollers 3 and the grate 4 in this embodiment. This control flow or routine is executed by the control device 101 repeatedly with a given period during operation of the corrugated paperboard sheet feeding apparatus 1.

First of all, in step S1, the control device 101 operates to determine whether or not the mat switch 36 (see FIG. 2) provided on an uppermost one of the steps 34 of the corrugated paperboard sheet feeding apparatus 1 has been turned on. In other words, the control device 101 operates to determine whether or not a person has entered the area for performing work in the sheet feeding section 31. As a result of the determination in the step S1, when the mat switch 36 is determined to have been turned on (step S1: YES), the processing routine proceeds to step S2. On the other hand, when the mat switch 36 is not determined to have been turned on (step S1: NO), the processing routine is terminated.

In the step S2, the control device 101 operates to determine whether or not one operation cycle of the sheet feeding rollers 3 and the grate 4 have been completed. As a result, when the one operation cycle is determined to have been completed (step S2: YES), the processing routine proceeds to step S3.

In the step S3, the control device 101 operates to stop the movements of the sheet feeding rollers 3 and the grate 4. Specifically, the control device 101 operates to stop driving of the sheet feeding roller servomotors M1 and the grate servomotor M2 through the sheet feeding roller servo drive unit 110 and the grate servo drive unit 112 to thereby stop the movements of the sheet feeding rollers 3 (specifically, all of the plurality of sheet feeding rollers 3) and the grate 4. In this case, the control device 101 operates to maintain driving of the drive control unit 102, the printer control unit 104, the creaser-slotter control unit 106 and the die cutter control unit 108. That is, the control device 101 operates to stop the operation of the corrugated paperboard sheet feeding apparatus 1 but continue the operations of the printing apparatus PR, the creaser-slotter CS and the die cutter DC on the downstream side of the corrugated paperboard sheet feeding apparatus 1. After the step S3, the processing routine proceeds to step S4.

On the other hand, when the one operation cycle is not determined to have been completed (step S2: NO), the processing routine returns to the step S2. In this case, the control device 101 operated to repeat the determination at the step S2 to continue the movements of the sheet feeding rollers 3 and the grate 4, until the one operation cycle is completed.

In the step S4, the control device 101 operates to determine whether or not conditions that the mat switch 36 is changed from the ON state to the OFF state, and the release button 33A is turned on have been satisfied. As a result, when the conditions that the mat switch 36 is changed from the ON state to the OFF state and the release button 33A is turned on are determined to have been satisfied (step S4: YES), the processing routine proceeds to step S5.

In the step S5, the control device 101 operates to release the stopped state of the sheet feeding rollers 3 and the grate 4 to restart driving of the sheet feeding roller servomotors M1 and the grate servomotor M2 through the sheet feeding roller servo drive unit 110 and the grate servo drive unit 112 so as to restart the movements of the sheet feeding rollers 3 and the grate 4. Thus, the feed-out of corrugated paperboard sheets SH by the corrugated paperboard sheet feeding apparatus 1 is restarted.

On the other hand, when the conditions that the mat switch 36 is changed from the ON state to the OFF state and the release button 33A is turned on are not determined to have been satisfied (step S4: NO), the processing routine returns to step S4. In this case, the control device 101 repeats the determination at the step S4 to continue the stopped state of the sheet feeding rollers 3 and the grate 4, until the mat switch 36 is changed from the ON state to the OFF state and further the release button 33A is turned on.

<Functions/Advantageous Effects>

Functions/advantageous effects of the corrugated paperboard sheet feeding apparatus 1 according to this embodiment will be described below.

In the corrugated paperboard sheet feeding apparatus 1 according to this embodiment, the gap between each of the sheet feeding rollers 3 and a corresponding one of the opening portions 4*a* of the grate 4 is defined to have a relatively small size, specifically, the gap distance D between each of the sheet feeding rollers 3 and a corresponding one of the opening portions 4*a* of the grate 4 is set to 10 mm or less, so that it becomes possible to reduce a change in negative pressure generated in the suction box 2 by the suction device 17. This advantage will be more specifically described with reference to FIGS. 9A to 9D and FIG. 10.

Figures 9A, 9B, 9C, 9D:
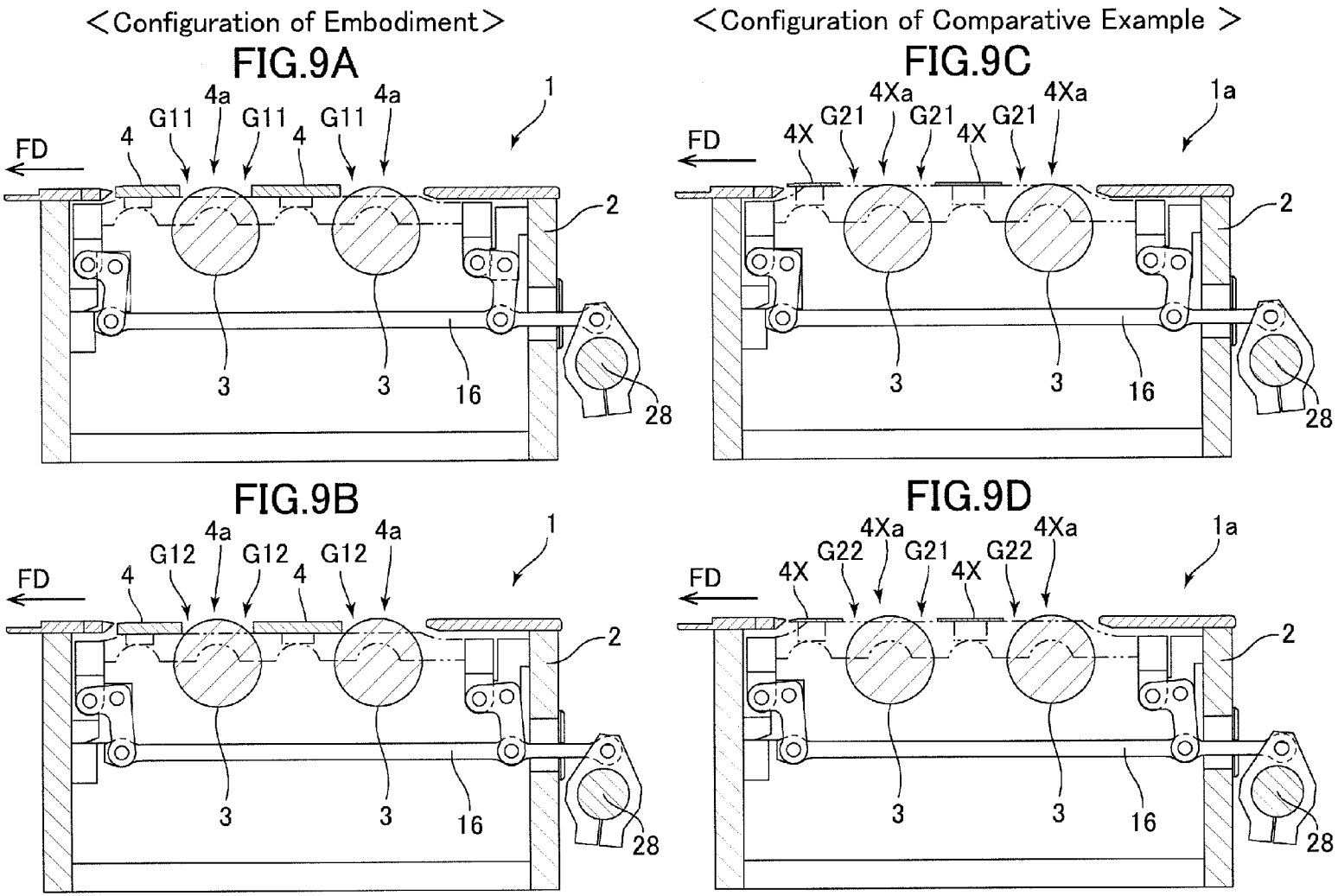
FIGS. 9A to 9D are sectional views depicting the corrugated paperboard sheet feeding apparatus according to this embodiment and a corrugated paperboard sheet feeding apparatus as a comparative example.

FIGS. 9A to 9D are sectional views corresponding to FIGS. 4A and 4B (taken along the line orthogonal to the feed-out direction FD), depicting the corrugated paperboard sheet feeding apparatus 1 according to this embodiment and a corrugated paperboard sheet feeding apparatus 1*a* as a comparative example. Specifically, FIGS. 9A and 9B depict, respectively, a state in which the grate 4 is at the raised position, and a state in which the grate 4 is at the lowered position, in the corrugated paperboard sheet feeding apparatus 1 according to this embodiment. On the other hand, FIGS. 9C and 9D depict, respectively, a state in which a grate 4X is at a raised position, and a state in which the grate 4X is at a lowered position, in the corrugated paperboard sheet feeding apparatus 1*a* as the comparative example. The corrugated paperboard sheet feeding apparatus 1*a* as the comparative example corresponds to a conventional corrugated paperboard sheet feeding apparatus.

As depicted in FIGS. 9A to 9D, in the corrugated paperboard sheet feeding apparatus 1*a* as the comparative example, a gap between each of a plurality of sheet feeding rollers 3 and a corresponding one of a plurality of openings 4Xa of the grate 4X is set to a distance greater than that of the gap between each of the sheet feeding rollers 3 and a corresponding one of the openings 4 of the grate 4. Specifically, a gap G21 (see FIG. 9C) at the raised position of the grate 4X in the corrugated paperboard sheet feeding apparatus 1*a* as the comparative example is greater than the G11 at the raised position of the grate 4 in the corrugated paperboard sheet feeding apparatus 1 according to this embodiment, and a gap G22 (see FIG. 9D) at the lowered position of the grate 4X in the corrugated paperboard sheet feeding apparatus 1*a* as the comparative example is greater than the G12 at the lowered position of the grate 4 in the corrugated paperboard sheet feeding apparatus 1 according to this embodiment. For example, in the corrugated paperboard sheet feeding apparatus 1 according to this embodiment, the gap distance D at the raised position of the grate 4 is about 5 mm, and the gap distance D at the lowered position of the grate 4 is about 2.5 mm, whereas, in the corrugated paperboard sheet feeding apparatus 1*a* as the comparative example, the gap distance D at the raised position of the grate 4X is about 18 mm, and the gap distance D at the lowered position of the grate 4X is about 15 mm.

Figure 10:
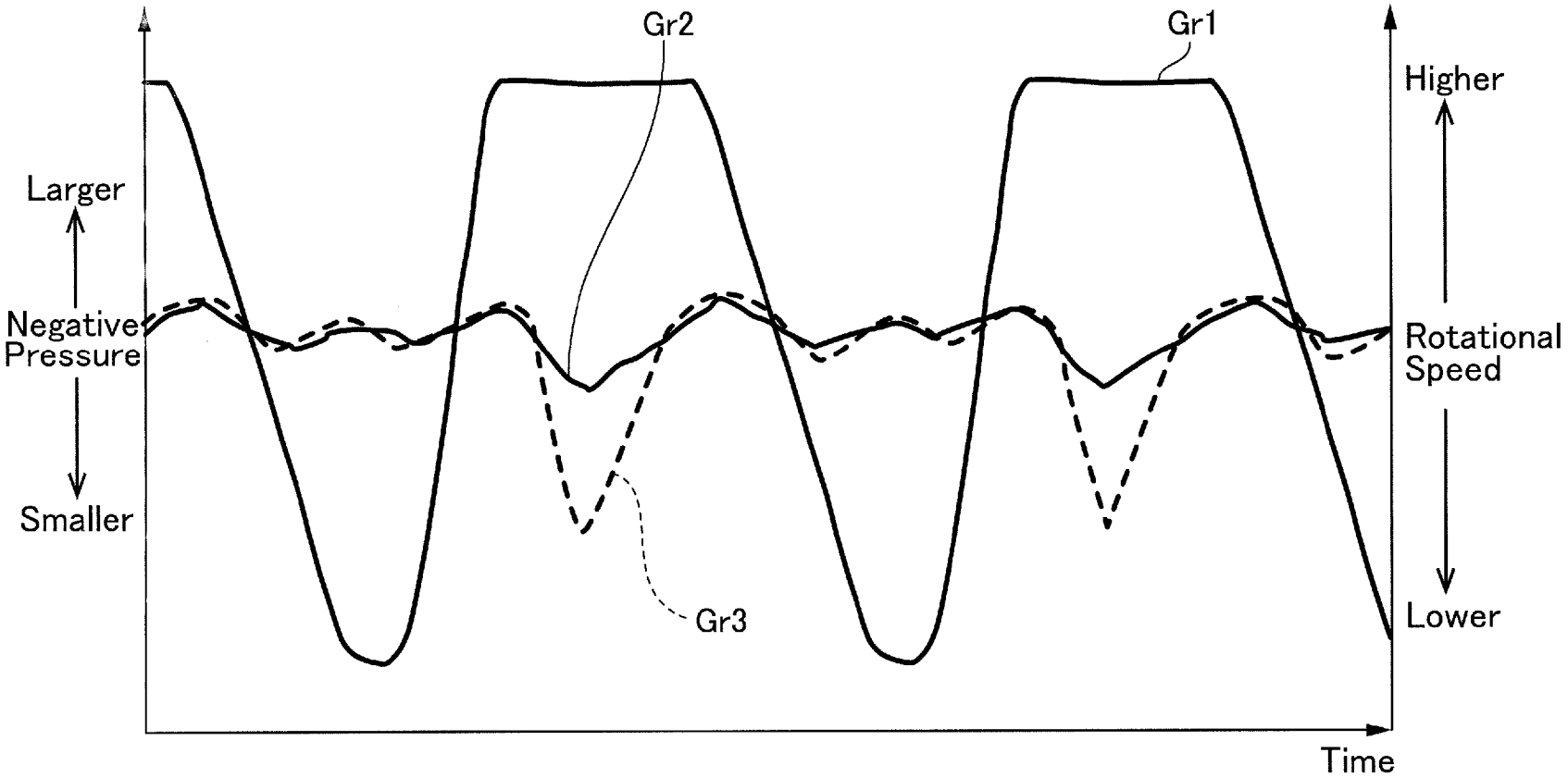
FIG. 10 is a diagram depicting changes in negative pressure, obtained from the corrugated paperboard sheet feeding apparatus according to this embodiment and the corrugated paperboard sheet feeding apparatus as the comparative example.

FIG. 10 is a diagram depicting changes in negative pressure, obtained from the corrugated paperboard sheet feeding apparatus 1 according to this embodiment and the corrugated paperboard sheet feeding apparatus 1*a* as the comparative example. In FIG. 10, the curve Gr1 indicates a temporal change in rotational speed (equivalent to a speed control pattern) of the sheet feeding rollers 3, and each of the curves Gr2, Gr3 indicates a change (temporal change) in negative pressure generated in the suction box 2 by the suction device 17, in a state in which the sheet feeding rollers 3 are driven as indicated by the curve Gr1. Specifically, the curve Gr2 indicates a change in the negative pressure in the corrugated paperboard sheet feeding apparatus 1 according to this embodiment, the curve Gr3 indicates a change in the negative pressure in the corrugated paperboard sheet feeding apparatus 1*a* as the comparative example. The curves Gr2, Gr3 can be obtained by experiment or simulation. The curves Gr2, Gr3 show that, in the corrugated paperboard sheet feeding apparatus 1 according to this embodiment, the change in negative pressure generated in the suction box 2 by the suction device 17 is relatively small, as compared to the corrugated paperboard sheet feeding apparatus 1*a* as the comparative example.

The reason that a difference in magnitude of the change in the negative pressure occurs between this embodiment and the comparative example is as follows. Firstly, when one corrugated paperboard sheet SH is gradually fed out, a region of the sheet feeding section 31 on which no corrugated paperboard sheet SH is placed is gradually increased, and air is allowed to flow into the suction box through gaps between corresponding ones of the sheet feeding rollers 3 and the openings 4*a* of the grate 4 in the region on which no corrugated paperboard sheet SH is placed, so that the negative pressure generated in the suction box 2 by the suction device 17 is gradually reduced. Therefore, during feed-out of a corrugated paperboard sheet SH, the magnitude of the negative pressure generated in the suction box 2 by the suction device 17 changes.

In the corrugated paperboard sheet feeding apparatus 1 according to this embodiment, the gap between each of the sheet feeding rollers 3 and a corresponding one of the opening portions 4*a* of the grate 4 is set to a relatively small distance, as compared to the corrugated paperboard sheet feeding apparatus 1*a* as the comparative example, so that an amount of air to be allowed to flow into the suction box through the gaps in the above manner is reduced, and thus the change in negative pressure generated in the suction box 2 by the suction device 17 during feed-out of the lowermost corrugated paperboard sheet SH becomes smaller.

Therefore, in the corrugated paperboard sheet feeding apparatus 1 according to this embodiment, the change in negative pressure generated in the suction box 2 by the suction device 17 can be reduced, so that it becomes possible to continue to adequately apply a gripping force from the sheet feeding rollers 3 to the lowermost corrugated paperboard sheet SH during feed-out of the lowermost corrugated paperboard sheet SH. This makes it possible to ensure accuracy in feed-out of the lowermost corrugated paperboard sheet SH, i.e., to suppress a deviation in sheet feeding during feed-out of the lowermost corrugated paperboard sheet SH.

The gap distance D between each of the sheet feeding rollers 3 and a corresponding one of the opening portions 4*a* of the grate 4 may be set to 10 mm or less. In this case, it becomes possible to suppress the change in the negative pressure to an extent capable of adequately suppressing such a deviation in sheet feeding. More preferably, the gap distance D between each of the sheet feeding rollers 3 and a corresponding one of the opening portions 4*a* of the grate 4 is set to 5 mm or less. In this case, it becomes possible to further reduce the change in the negative pressure and effectively suppress a deviation in sheet feeding during feed-out of the lowermost corrugated paperboard sheet SH.

As above, the gap between each of the sheet feeding rollers 3 and a corresponding one of the opening portions 4*a* of the grate 4 may be defined to have a relatively small distance as in this embodiment. In this case, however, when a worker performs work in the sheet feeding section 31 during operation of the corrugated paperboard sheet feeding apparatus 1, there is a risk that fingers of the worker entering a gap between a certain one of the sheet feeding rollers 3 and a corresponding one of the opening portions 4*a* of the grate 4 are caught between the certain sheet feeding roller 3 and the grate 4, as mentioned in the Section "Technical Problem". The corrugated paperboard sheet feeding apparatus 1 according to this embodiment addresses this technical problem by using the mat switch 36 to detect an entry of a person into the area for performing work in the sheet feeding section 31, and stopping the movements of the sheet feeding rollers 3 and the grate 4 when the mat switch 36 is turned on. Thus, the corrugated paperboard sheet feeding apparatus 1 according to this embodiment can reliably prevent worker's fingers from being caught between a certain one of the sheet feeding rolls 3 and the grate 4.

In this embodiment, the movements of the sheet feeding rollers 3 and/or the grate 4 are stopped at the timing when one operation cycle of the sheet feeding rollers 3 and the grate 4 is completed after the mat switch 36 is turned on (see FIGS. 7 and 8). This makes it possible to suppress defective feed-out of a corrugated paperboard sheet SH and defective processing (e.g., defective printing) on the downstream side of the corrugated paperboard sheet feeding apparatus 1.

In this embodiment, when the mat switch 36 is changed from the ON state to the OFF state in a situation where the movements of the sheet feeding rollers 3 and the grate 4 are stopped, and the release button 33A is turned on, the stopped state of the sheet feeding rollers 3 and the grate 4 is released to restart the movements of them. This makes it possible to restarts the movements of the sheet feeding rollers 3 and grate 4 under a condition that there is no possibility that fingers of the person are caught between any one of the sheet feeding rolls and the grate in the corrugated paperboard sheet feeding apparatus 1.

In this embodiment, the corrugated paperboard sheet feeding apparatus 1 is configured such that the sheet feeding rollers 3 and the grate 4 are driven, independently of the apparatuses on the downstream side of the corrugated paperboard sheet feeding apparatus 1 (the printing apparatus PR, the creaser-slotter CS and the die cutter DC) (see FIG. 6), so that it becomes possible to adequately continue the operations of the apparatuses on the downstream side of the corrugated paperboard sheet feeding apparatus 1, even when the movements of the sheet feeding rollers 3 and the grate 4 are stopped. This allows the apparatuses on the downstream side of the corrugated paperboard sheet feeding apparatus 1 to perform processing for a corrugated paperboard sheet SH which has already been fed out from the corrugated paperboard sheet feeding apparatus 1, even when the operation of the corrugated paperboard sheet feeding apparatus 1 is stopped.

As an alternative technique of preventing worker's fingers from being caught between a certain one of the sheet feeding rollers 3 and the grate 4 in the corrugated paperboard sheet feeding apparatus 1 where the gap between each of the sheet feeding rollers 3 and a corresponding one of the opening portions 4*a* of the grate 4 is set to a relatively small distance, it is conceivable to employ a cover for covering a region of the sheet feeding section 31 on which no corrugated paperboard sheet SH is placed (in the case where a corrugated paperboard sheet SH having a relatively small width is employed, such a region occurs in each of width-wisely opposite edges of the sheet feeding section). However, this technique is not adequate because the cover hinders a movement of the back guide 14 for guiding a rear edge of each of the stacked corrugated paperboard sheets SH, in the feed-out direction FD.

The corrugated paperboard sheet feeding apparatus using the mechanical transmission as described in the aforementioned Patent Document 1 has difficulty in being quickly stopped due to an inertia moment of the mechanical transmission. Moreover, an approach to quickly stop the apparatus exerts a negative influence on an internal structure of the apparatus. In contrast, the corrugated paperboard sheet feeding apparatus 1 according to this embodiment is configured to control components (each of the set of sheet feeding rollers 3 and the grate 4), respectively, by individual motors, without using such a mechanical transmission, so that the problems in the corrugated paperboard sheet feeding apparatus described in the Patent Document 1 never occur.

<Modifications>

Some modifications of the above embodiment will be described below.

In the above embodiment, when the mat switch 36 is turned on, the movements of the sheet feeding rollers 3 and the grate 4 are stopped at the timing when one operation cycle of the sheet feeding rollers 3 and the grate 4 is completed. Alternatively, with a view to reliably preventing worker's fingers from being caught between a certain one of the sheet feeding rollers 3 and the grate 4 in the corrugated paperboard sheet feeding apparatus 1, the movements of the sheet feeding rollers 3 and the grate 4 may be quickly stopped after the mat switch 36 is turned on without waiting for the completion of one operation cycle of the sheet feeding rollers 3 and the grate 4.

In the above embodiment, respective movements of the sheet feeding rollers 3 and the grate 4 in the corrugated paperboard sheet feeding apparatus 1 are stopped. Alternatively, only the movement of the grate 4 may be stopped without stopping the movement of the sheet feeding rollers 3. There is a risk that worker's fingers are caught between a certain one of the sheet feeding rollers 3 and the grate 4 when the grate 4 is lowered, i.e., the event that worker's fingers are caught between a certain one of the sheet feeding rolls 3 and the grate 4 is primarily caused by the movement of the grate 4. Thus, as mentioned above, only the movement of the grate 4 is stopped, and the movement of the sheet feeding rolls 3 is maintained. This makes it possible to minimize the number of components to be stopped, and thereby facilitate restarting from the stopped state.

In the above embodiment, the mat switch 36 is used to detect an entry of a person into the area for performing work in the sheet feeding section 31. Alternatively, an entry of a person into the area for performing work in the sheet feeding section 31 may be detected using a sensor utilizing laser, or a camera, instead of the mat switch 36.

What is claimed is:

1. A corrugated paperboard sheet feeding apparatus for feeding out a plurality of stacked corrugated paperboard sheets one-by-one, comprising:

a plurality of sheet feeding rollers rotatably arranged along a feed-out direction of the corrugated paperboard sheets, and configured to feed out a lowermost one of the stacked corrugated paperboard sheets;

an elevating member formed in a plate shape to allow the corrugated paperboard sheets to be placed thereon and formed with a plurality of opening portions capable of receiving therein the plurality of sheet feeding rollers, respectively, the elevating member being configured to be raised and lowered with respect to the sheet feeding rollers in order to switch between a contact state and a non-contact state of the lowermost corrugated paperboard sheet with respect to the sheet feeding rollers; and a housing having an upper region in which the sheet feeding rollers and the elevating member are provided to define a part of an upper surface of the housing, the housing being further provided with a suction device and configured to suck the lowermost corrugated paperboard sheet downwardly by gaps between corresponding ones of the sheet feeding rollers and the opening portions of the elevating member, by using suctioning of the suction device, wherein each of the gaps between corresponding ones of the sheet feeding rollers and the opening portions of the elevating member is formed to be 10 mm or less in size, wherein the corrugated paperboard sheet feeding apparatus further comprises:

a human detecting device configured to detect an entry of a person into an area for performing work in a sheet feeding section including the sheet feeding rollers and the elevating member, during feed-out of the corrugated paperboard sheets; and a control device configured, when the human detecting device detects the entry of a person, to stop movement of at least one of the sheet feeding rollers and the elevating member, wherein the corrugated paperboard sheet feeding apparatus further comprises a release button for releasing a stopped state of the at least one of the sheet feeding rollers and the elevating member, which is established by the control device, and wherein the control device is configured, when the human detecting device comes not to detect any person and the release button is turned on, to release the stopped state of the at least one of the sheet feeding rollers and the elevating member and restart the movement of the at least one of them.

2. The corrugated paperboard sheet feeding apparatus according to claim 1, wherein the control device is configured to stop the movement of at least one of the sheet feeding rollers and the elevating member, at a timing when one operation cycle of the sheet feeding rollers and the elevating member for feeding out the lowermost corrugated paperboard sheet is completed.

3. The corrugated paperboard sheet feeding apparatus according to claim 1, wherein the control device is configured to stop movements of both the sheet feeding rollers and the elevating member.

4. The corrugated paperboard sheet feeding apparatus according to claim 1, wherein the control device is configured to stop only the movement of the elevating member without stopping the movement of the sheet feeding rollers.

5. The corrugated paperboard sheet feeding apparatus according to claim 1, wherein each of the gaps between corresponding ones of the sheet feeding rollers and the opening portions of the elevating member is formed to be 5 mm or less in size.

6. The corrugated paperboard sheet feeding apparatus according to claim 1, wherein the human detecting device is a mat switch provided on a floor surface of the area for performing the work in the sheet feeding section.

7. The corrugated paperboard sheet feeding apparatus according to claim 1, wherein the sheet feeding rollers and the elevating member are configured to be driven independently of an apparatus which performs processing of the corrugated paperboard sheet fed out from the corrugated paperboard sheet feeding apparatus, and which is disposed on a downstream side of the corrugated paperboard sheet feeding apparatus.

* * * * *